US007704165B2

(12) United States Patent
Pommereau

(10) Patent No.: US 7,704,165 B2
(45) Date of Patent: Apr. 27, 2010

(54) GOLF BALL SUPPORT OR TEE

(76) Inventor: Claude Pommereau, 7 Allée Michel de Montaigne, F-91210 Draveil (FR)

( * ) Notice: Subject to any disclaimer, the term of this patent is extended or adjusted under 35 U.S.C. 154(b) by 0 days.

(21) Appl. No.: 10/570,705

(22) PCT Filed: Sep. 2, 2004

(86) PCT No.: PCT/FR2004/002232

§ 371 (c)(1),
(2), (4) Date: Mar. 3, 2006

(87) PCT Pub. No.: WO2005/028040

PCT Pub. Date: Mar. 31, 2005

(65) Prior Publication Data

US 2006/0287135 A1 Dec. 21, 2006

(30) Foreign Application Priority Data

Sep. 5, 2003 (FR) ..... 03 10502

(51) Int. Cl.
*A63B 69/36* (2006.01)

(52) U.S. Cl. ..... 473/387

(58) Field of Classification Search ..... 473/386–403
See application file for complete search history.

(56) References Cited

U.S. PATENT DOCUMENTS

| | | | | |
|---|---|---|---|---|
| 1,573,911 | A * | 2/1926 | Budrow | 473/396 |
| 2,033,269 | A * | 3/1936 | Williams | 473/257 |
| 3,473,812 | A * | 10/1969 | Pelzmann | 473/278 |
| 3,506,263 | A | 4/1970 | Arrington | |
| 3,749,409 | A | 7/1973 | Redmon | |
| 3,947,027 | A * | 3/1976 | Brown | 473/278 |
| 4,367,879 | A * | 1/1983 | Messer | 473/278 |
| 4,787,637 | A * | 11/1988 | Lima et al. | 473/396 |
| 5,193,803 | A * | 3/1993 | Flick, III | 473/392 |
| 5,259,622 | A | 11/1993 | Irving | |
| 5,383,668 | A | 1/1995 | Andrikian | |
| 5,492,323 | A * | 2/1996 | Lee | 473/278 |
| 5,738,598 | A * | 4/1998 | Wu | 473/392 |
| 2002/0022538 | A1 | 2/2002 | Choi | |

FOREIGN PATENT DOCUMENTS

| | | |
|---|---|---|
| WO | WO 91/17801 | 11/1991 |
| WO | WO 98/03232 | 1/1998 |

* cited by examiner

*Primary Examiner*—Steven Wong
(74) *Attorney, Agent, or Firm*—Greer, Burns & Crain, Ltd.

(57) ABSTRACT

The invention relates to a novel golf ball support or tee comprising a lower part which is fixed to the practice surface and an upper part which is disposed above ground. The upper end of the upper part comprises a surface which receives the golf ball. According to the invention, the support comprises an obstacle-forming protrusion which prevents the ball from moving during the positioning thereof. Said protrusion extends upwards from at least one side of the upper part of the device, such that, when the ball is in the rest position on the receiving surface, the protrusion and the ball are not in contact with one another.

10 Claims, 1 Drawing Sheet

GOLF BALL SUPPORT OR TEE

BACKGROUND

This invention relates to a golf ball support or tee. The principal function of a tee is to maintain the golf ball elevated so that the golfer may hit the ball without touching the ground. This invention relates more particularly, but not exclusively, to the practice area where the golfer plays several shots with the help of a dispenser which delivers the golf balls onto a tee fixed to the practice mat. However, the tee according to the invention can also be used when the ball is placed in position by hand.

Currently, conventional tees are used with golf ball dispensers. To avoid the golf ball falling off the receiving surface of the tee during positioning, dispensing is performed in a quite complex manner, as shown in document WO 9803232 where the distribution arm comprises a loop designed to place the ball very gently onto the tee.

SUMMARY

The purpose of this invention is to produce a novel tee capable of receiving a golf ball placed in position by hand or by using a golf ball dispenser, and keeping the ball on its receiving surface.

The purpose of the invention is also to produce a flexible tee offering a minimum of resistance when hit by a golf club during a shot.

At least one of the above-mentioned objectives is achieved with a golf ball support or tee comprising a lower part intended to remain on a substrate such as the ground and an upper part above the ground; the upper part comprising on its upper end, a receiving surface for a golf ball. The support according to the invention comprises a return protrusion which prevents the ball from falling off when placed in position. This protrusion extends upwards from at least one side of the upper part.

With such a support, when a golf ball dispenser is used which delivers the ball at a certain speed, the protrusion allows the ball to be guided onto the receiving surface. A person skilled in the art will readily understand that this protrusion is provided on the side opposite to that from which the ball arrives. Advantageously, the support may be constituted at least by natural rubber and approximately 70% by a butyl-based material in order to prevent the golf ball bouncing when it is placed in position and to ensure flexibility when struck. It also comprises other standard materials.

However, the support may be constituted by approximately 100% butyl-based material.

According to an advantageous characteristic of the invention, the central part between the upper part and the lower part has a reduced diameter in order to provide a bending zone. Thus, the support may bend easily when struck by a golfer's club. Therefore, the resistance of the support with respect to the club is minimized, enabling the effect of the impact between club and support on the trajectory to be reduced or even eliminated.

According to an advantageous embodiment of the invention, the upper part has a parabolic or conical shape with the end having the smallest diameter arranged downwards.

Moreover, to ensure that the protrusion is not in the striking area, it is designed in such a way that it has a width of less than or equal to three-quarters of the diameter of the tee. In addition, when the golf ball is in the rest position on the receiving surface, the protrusion and the ball are separated from one another and are therefore not in contact. As a non-limitative example, the distance between the protrusion and the golf ball is approximately equal to 2 mm.

The lower part may comprise a base in the form of a disk positioned horizontally and designed to be fixed to a practice mat.

BRIEF DESCRIPTION OF THE DRAWINGS

Other advantages and characteristics of the invention will appear on examination of the detailed description of a non-limitative embodiment, and the attached drawings, in which.

DETAILED DESCRIPTION OF THE PREFERRED EMBODIMENT

Figure 1:
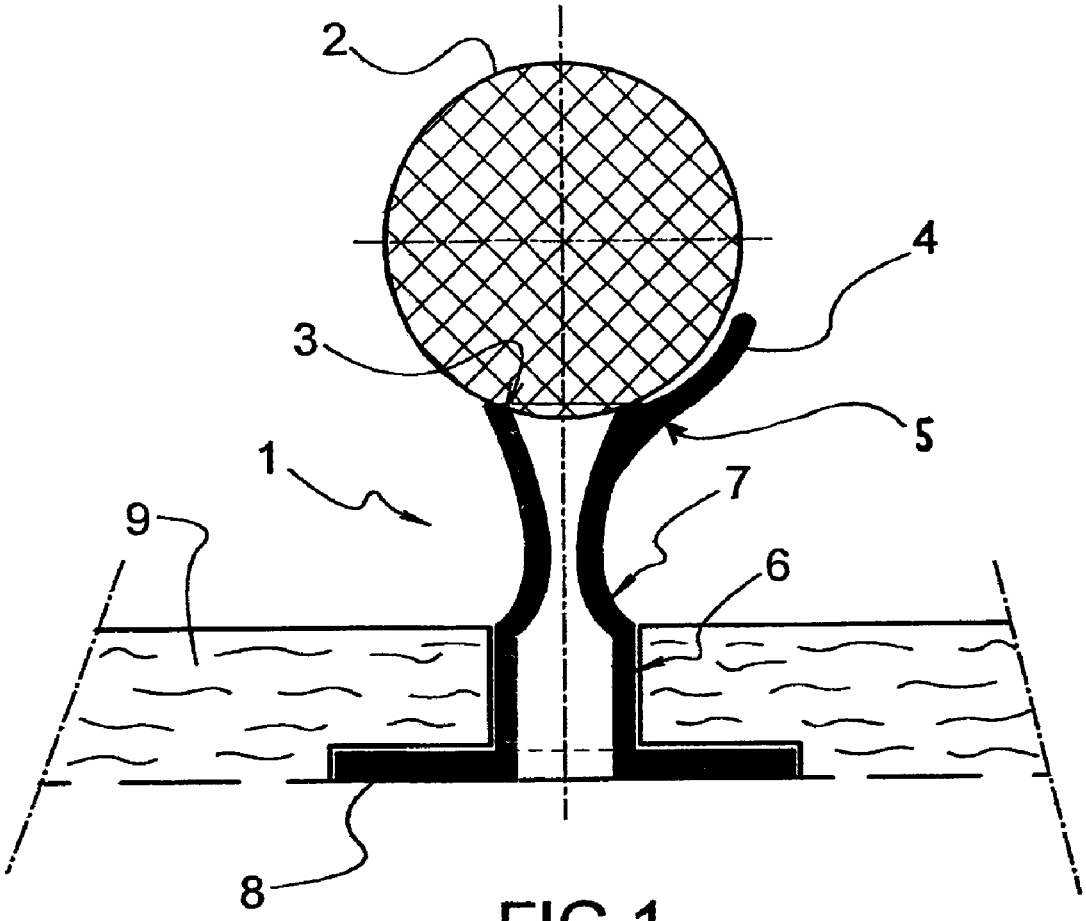
FIG. 1 is a lateral sectional view of the support according to the invention.

FIG. 1 shows the support 1 holding a golf ball 2 in the rest position. The ball 2 has been placed in position by means of a golf ball dispenser which is not shown.

The body of the support 1 is constituted by a mixture of butyl and natural rubber, giving it flexibility and strength. This body may be solid or hollow, as shown on FIGS. 1 and 2.

The support 1 is constituted by an upper part 5, a bending zone 7 and a lower part 6, all three of which may be contained within a straight vertical cylinder. In order to provide for a secure attachment to the practice mat 9, the lower part 6 rests on a disk 8 acting as a base to the support 1. The disk 8 has a diameter of 54 mm with a thickness of 3 mm. The lower part comprises a shaft of about 16 mm in diameter with a height approximately identical to the thickness of the mat. For mats 35 mm thick, tees may be produced which have a total height of 42 mm or 65 mm. For mats 15 mm thick, tees may be produced which have a total height of 25 mm or 48 mm.

The upper part 5 has a conical shape, flared out towards the top. The bending zone has a reduced diameter with respect to the shaft of the lower part and to the receiving surface 3 of the upper part. Thus, when a golfer strikes the upper part 5 while striking the golf ball 2, this upper part can bend easily with a minimum of resistance. The trajectory and the golf club swing are not disturbed.

The receiving surface 3 is located at the end of the upper part, in the form of a ring shaped in such a way as to accept the ball. Its diameter may be 15 mm or 18 mm.

Figure 2:
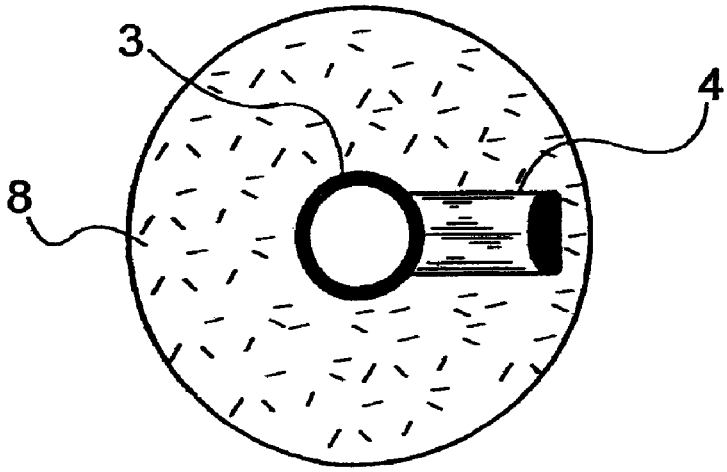
FIG. 2 is a top view of the support according to the invention.

As shown in FIGS. 1 and 2, on one side of the upper part a protrusion 4 is located, extending obliquely upwards. This protrusion is sufficiently rigid and elastic to guide the ball onto the receiving surface when it is placed in position. It acts as a convex-shaped guide arm. As shown, the protrusion is formed as an arcuate solid, aperture-free surface. It is arranged in such a way that there is a space of approximately 2 mm between it and the ball in the rest position. There is no contact between the protrusion and the ball in the rest position.

Of course, the invention is not limited to the examples described above, and many modifications may be made to these examples without exceeding the scope of the invention.

The invention claimed is:

1. A golf ball support comprising:

a lower part including a base constructed to be maintained on a substrate, and an upper part above the substrate, said upper part comprising on an upper end defining a receiving surface for a golf ball and a reduced diameter section forming a bending zone with a diameter that is less than a diameter of said lower part, wherein said bending zone allows the support to bend when contacted by a golf club;

a return protrusion attached to said upper part and configured for preventing the golf ball from falling off said upper part and for guiding the golf ball onto said receiving surface when the golf ball is placed in position by a golf ball dispenser, said protrusion being an arcuate solid, aperture-free surface extending upwardly from at least one side of said upper part, said protrusion deviating obliquely from said receiving surface and configured relative to said receiving surface such that when the golf ball is in the rest position on the receiving surface, said protrusion and the ball are separated from one another.

2. The support according to claim 1, characterized in that the upper part has a conical shape.

3. The support according to claim 1, characterized in that the upper part has a parabolic shape.

4. The support according to claim 1, characterized in that the base is in the form of a disk arranged horizontally and intended to be fixed to a practice mat.

5. The support according to claim 1, characterized in that it is constituted by at least a natural rubber and approximately 70% of a butyl-based material in order to prevent the golf ball from bouncing when placed in position and to ensure flexibility when struck.

6. The support according to claim 1, characterized in that it is constituted by approximately 100% butyl-based material.

7. The support according to claim 1, characterized in that the distance between the protrusion and the golf ball is approximately equal to 2 mm.

8. The support according to claim 1, characterized in that the protrusion has a width less than or equal to three-quarters of the diameter of the tee.

9. A golf ball support comprising:

a lower part including an annular disk intended to be maintained on a substrate and an upper part above the substrate, said upper part defining a single, continuous receiving surface for a golf ball;

a return protrusion attached to said upper part and configured for preventing the golf ball from falling off said upper part and for guiding the golf ball onto said receiving surface when the golf ball is placed in position by a golf ball dispenser, said protrusion being an arcuate solid, aperture-free surface extending upwardly from at least one side of said upper part, said protrusion deviating obliquely from said receiving surface, wherein when the golf ball is in the rest position on the receiving surface, said protrusion and the ball are separated from one another; and a central section between said upper part and said lower part, each of said upper part, said lower part and said central section having a diameter, said diameter of said central section being less than said diameters of said upper part and said lower part to define a bending zone for allowing the support to bend when contacted by a golf club.

10. The support of claim 9 wherein said receiving surface is generally ring-shaped.

* * * * *